US009924815B2

(12) United States Patent
Canty

(10) Patent No.: US 9,924,815 B2
(45) Date of Patent: Mar. 27, 2018

(54) SOUND EMITTING FEEDING UTENSIL

(71) Applicant: PB&J Innovations, LLC, Asheville, NC (US)

(72) Inventor: Curtis L. Canty, Fairview, NC (US)

(73) Assignee: PB&J Innovations, LLC, Asheville, NC (US)

( * ) Notice: Subject to any disclaimer, the term of this patent is extended or adjusted under 35 U.S.C. 154(b) by 0 days.

(21) Appl. No.: 15/401,883

(22) Filed: Jan. 9, 2017

(65) Prior Publication Data

US 2017/0196385 A1 Jul. 13, 2017

Related U.S. Application Data

(60) Provisional application No. 62/276,560, filed on Jan. 8, 2016.

(51) Int. Cl.
*B26B 11/00* (2006.01)
*A47G 21/02* (2006.01)
*A47G 21/04* (2006.01)

(52) U.S. Cl.
CPC ..... *A47G 21/02* (2013.01); *A47G 21/04* (2013.01); *B26B 11/008* (2013.01); *A47G 2200/143* (2013.01)

(58) Field of Classification Search
CPC ..... A47G 21/02; A47G 23/12; A63H 33/00; G01G 19/56
USPC ..... 30/123, 142
See application file for complete search history.

(56) References Cited

U.S. PATENT DOCUMENTS 4,433,918 A * 2/1984 Nishimura ..... G04G 13/025 368/185
5,075,970 A 12/1991 Albert
2007/0251097 A1 11/2007 Terry
2008/0134520 A1 6/2008 Kormandel
2014/0193017 A1* 7/2014 Fortin ..... H04R 1/021 381/334
2014/0312135 A1* 10/2014 Hyde ..... A47G 21/04 239/6

FOREIGN PATENT DOCUMENTS

WO 0217752 A1 3/2002
WO PCTCA2007000080 1/2007

* cited by examiner

*Primary Examiner* — George Monikang
(74) *Attorney, Agent, or Firm* — The Van Winkle Law Firm; William G. Heedy; David M. Carter

(57) ABSTRACT

A waterproof, sound emitting feeding utensil includes a handle surrounding an inner cavity, a utensil shaped tip that is interchangeably securable to the handle, a waterproof, magnetic speaker sized and configured for storage in the inner cavity of the handle, a printed circuit board located in the inner cavity of the handle, the printed circuit board including a plurality of switches in connection with a sound chip that includes a plurality of digital sound files, each of the plurality of switches being linked to a corresponding one of the plurality of digital sound files, and wherein the printed circuit board is in electrical connection with the magnetic speaker, and a plurality of buttons mounted within the handle, each of the plurality of buttons being depressible against a corresponding one of the plurality of switches on the printed circuit board for causing the corresponding one of the plurality of digital sound files to play through the magnetic speaker.

5 Claims, 5 Drawing Sheets

SOUND EMITTING FEEDING UTENSIL

RELATED APPLICATION

This application claims priority to and incorporates entirely by reference U.S. Provisional Patent Application Ser. No. 62/276,560 filed on Jan. 8, 2016.

FIELD OF THE INVENTION

This invention relates to infant feeding utensils, and more particularly to such utensils that are more entertaining to the infant.

DESCRIPTION OF THE RELATED ART

Small infants are fed soft foods from a utensil, such as a spoon or fork that is designed to fit into the infant's mouth. While feeding the infant, the parent or guardian will scoop up a bit of food on the utensil and then playfully move the utensil up and down and side to side in front of the infant before depositing the bite into the infant's mouth. In some instances, the parent or guardian will accompany the movement of the utensil with a verbally produced, simulated motor boat or airplane sound that terminates when the food is deposited in the mouth. Unfortunately, because most parent or guardians are only able to make a few sounds, the effectiveness of manually feeding an infant with an accompanying verbal sound is reduced after a few weeks. After each use, the utensil must be thoroughly cleaned with hot water and soap. What is needed is a waterproof, infant feeding utensil that selectively generates different sounds while eating.

SUMMARY OF THE INVENTION

In accordance with one form of this invention, there is provided a waterproof, sound emitting feeding utensil including a handle surrounding an inner cavity, a utensil shaped tip that is interchangeably securable to the handle, a waterproof, magnetic speaker sized and configured for storage in the inner cavity of the handle, a printed circuit board located in the inner cavity of the handle, the printed circuit board including a plurality of switches in connection with a sound chip that includes a plurality of digital sound files, each of the plurality of switches being linked to a corresponding one of the plurality of digital sound files, and wherein the printed circuit board is in electrical connection with the magnetic speaker, and a plurality of buttons mounted within the handle, each of the plurality of buttons being depressible against a corresponding one of the plurality of switches on the printed circuit board for causing the corresponding one of the plurality of digital sound files to play through the magnetic speaker.

DESCRIPTION OF THE DRAWINGS

For a fuller understanding of the nature of the present invention, reference should be made to the following detailed description, taken in conjunction with the accompanying drawings in which.

Like reference numerals refer to like parts throughout the several views of the drawings.

DESCRIPTION OF THE PREFERRED EMBODIMENTS

Figure 1:
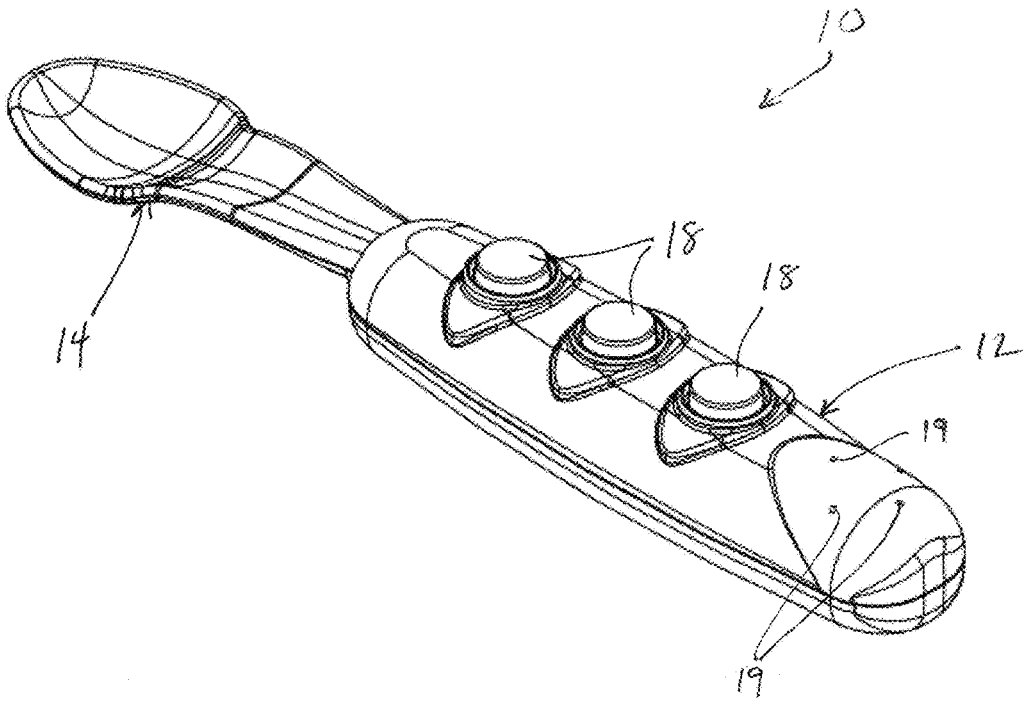
FIG. 1 is a perspective view of the feeding utensil of the present invention.
Figure 2:
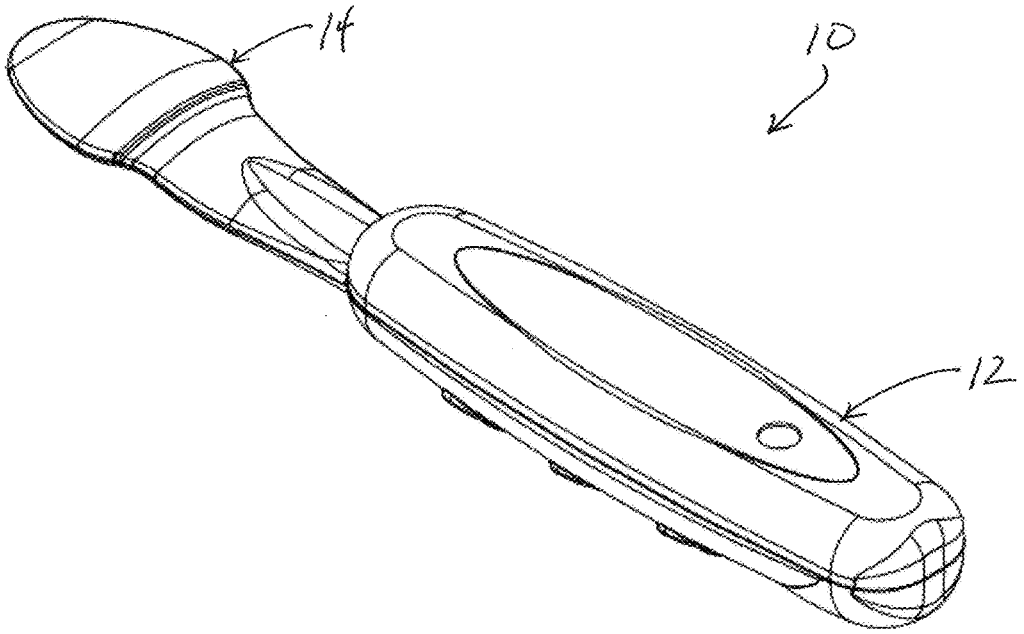
FIG. 2 is another perspective view of the feeding utensil of the present invention.
Figure 3:
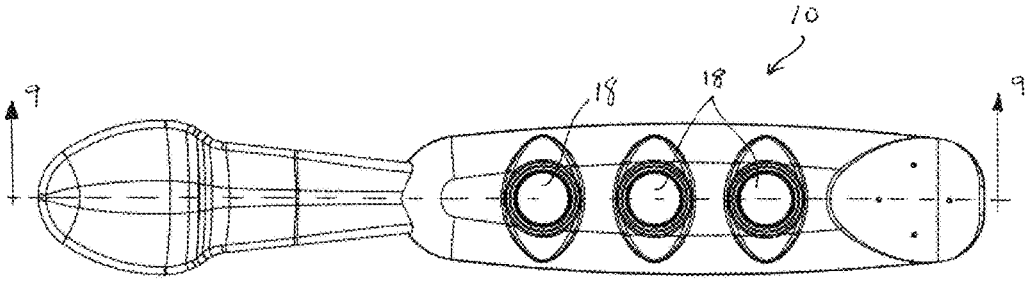
FIG. 3 is a top plan view of the feeding utensil.
Figure 4:
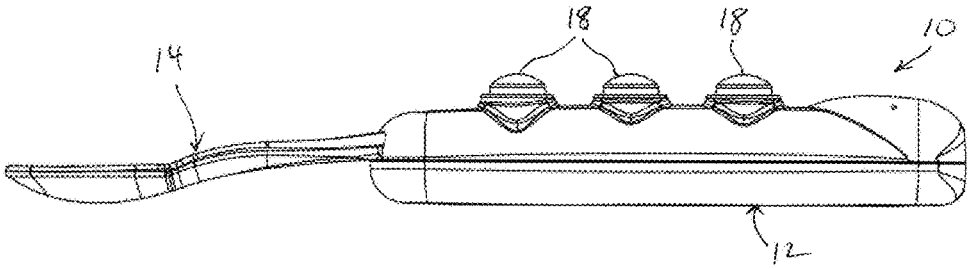
FIG. 4 is side elevational view of the feeding utensil.
Figure 5:
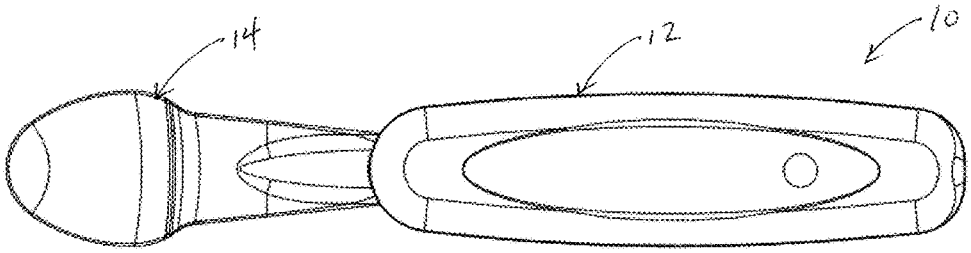
FIG. 5 is a bottom plan view of the feeding utensil.
Figure 6:
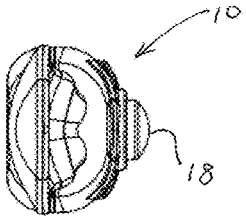
FIG. 6 is a front side view of the feeding utensil.
Figure 7:
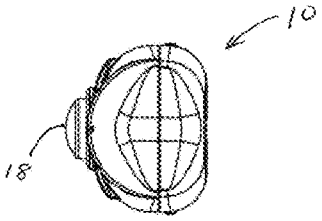
FIG. 7 is a rear side view of the feeding utensil.
Figure 8:
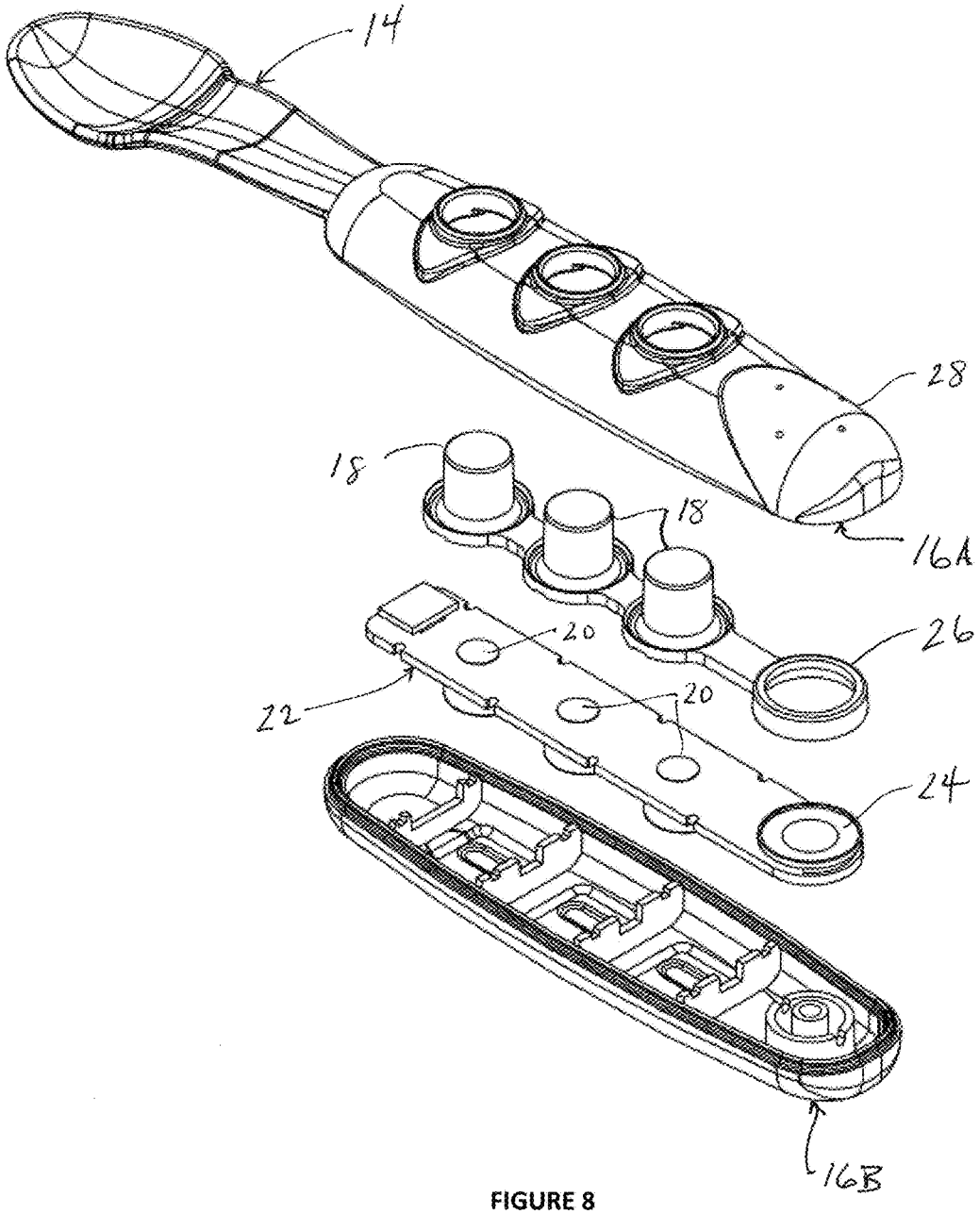
FIG. 8 is an exploded view of the feeding utensil.

Referring to the accompanying figures, the water-proof, sound emitting feeding utensil of the present invention is shown and described herein and is generally indicated as 10.

Referring primarily to FIGS. 1-8, the feeding utensil 10 includes a handle 12 with a separate or, in another embodiment, integrally-formed utensil shaped tip 14. The handle 12 is hollow, surrounding an inner cavity, and includes an upper body 16A and a lower body 16B. Mounted on the top surface of the handle 12 is a plurality of buttons 18 that when pressed, make contact with a corresponding switch 20 coupled to an enclosed circuit board 22. The circuit board 22 when activated plays a plurality of different sound files through a waterproof, magnetic speaker 24 also located inside the handle 12. A plurality of apertures 19 are on the upper body 16A for enhancing emission of the sound therethrough. The upper body 16A is an elongated structure that includes a rib that engages a corresponding slot formed on the lower body 16B for forming the handle 12.

An o-ring tab 26 is provided that creates a water tight seal. When the upper and lower bodies 16A and 16B are aligned and registered, the rib, o-ring and slot prevent water from entering the inner cavity and contacting the circuit board 22 located therein. Also formed by the upper body 16A is a bulbous member 28 surrounding a sound chamber 38 for enhancing the sound emitted by said magnetic speaker 24.

Figure 9:
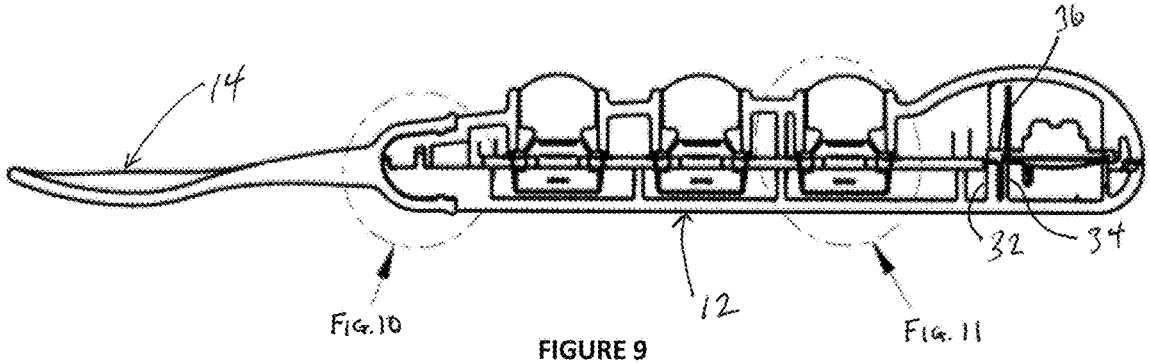
FIG. 9 is a cross sectional view of the feeding utensil taken from FIG. 3.
Figure 10:
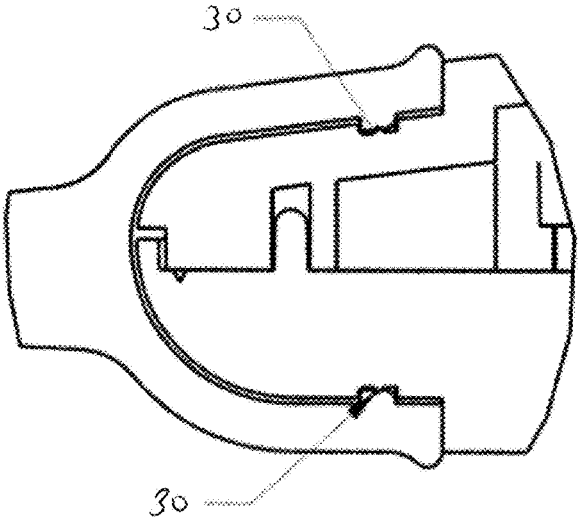
FIG. 10 is an isolated view taken from FIG. 9.
Figure 11:
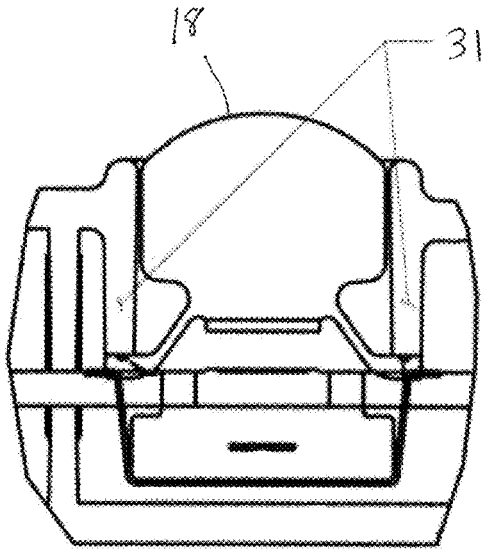
FIG. 11 is an isolated view taken from FIG. 9.

Now referring to FIGS. 9-11, the utensil shaped tip 14 is in a spoon shaped configuration that is selectively attached to one end of the handle 12. In the embodiment shown herein, the attachment mechanism is a groove 30. The groove 30 is sized for snap-fit attachment of the utensil shaped tip 14 to the handle 12 so that the utensil shaped tip 14 may be selectively removed and interchanged or cleaned. In one embodiment, a sonic welding bead is used in groove 30 to make the utensil shaped tip 14 permanently fixed to the handle 12. Formed on the upper body 16A are three button holes sized and shaped to permit a corresponding button 18 to pass therethrough. Formed for button holes on the upper body 16A is a button sealant rib. This feature is used to compress into the rubber or silicon button 18 to keep water from entering the cavity and contacting the circuit board 22. Formed inside the upper body is at least one circuit board guide post for positioning the circuit board 22 inside the handle 12 so that the circuit board 22 remains in a fixed position. Specifically referring to FIG. 11, a vertical flange 31 is provided as a safety device for preventing accidental removal of the corresponding button 18.

Figure 12:
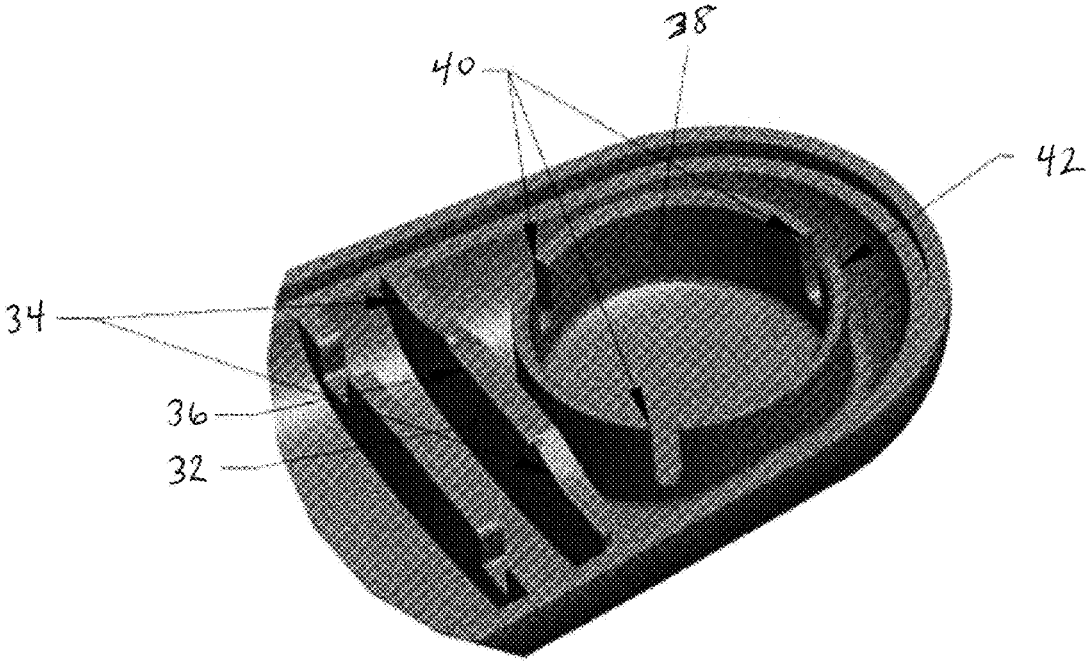
FIG. 12 is an isolated view of the distal end of the lower body of the handle of the feeding utensil.

As stated above, and referring specifically to FIG. 12, mounted on the lower body is a rib 32 used to keep water from entering the cavity. The rib has a flange 34 for guiding the assembly into the proper location and a flat rib 36 that compresses the o-ring tab 26 to insure a water tight seal.

Formed inside the handle 12 is a sound chamber. The flange 34 further serves to apply pressure from the tip around perimeter to the magnetic speaker 24 which forces pressure to the o-ring 26 to ensure a water tight seal. Formed on the sound chamber 38 are a plurality of wire slots 40. In one embodiment, located around the perimeter portion 42 of the sound chamber 38 is a slot and second o-ring that creates a watertight seal. During assembly, a magnetic speaker is secured therein with the wire from the speaker extending through the wire slot and connected to the circuit board 22. The wire slots 40 are also used for water to pass through and utilizes the speaker vibration to clear the sound chamber of liquid.

In one embodiment, the handle 12 of the utensil 10 is formed from a single, congruent, molded piece of material that is effectively sealed. The battery source may be rated lifetime for the unit. It is preferable that no labels or attachments be used which could be dislodged during feeding and/or cleaning.

While the present invention has been shown and described in accordance with several preferred and practical embodiments, it is recognized that departures from the instant disclosure are contemplated within the spirit and scope of the present invention.

What is claimed is:

1. A waterproof, sound emitting feeding utensil comprising:

a handle surrounding an inner cavity, said handle comprising an upper body and a lower body;

an o-ring tab;

a rib mounted on said lower body, said rib having a flange and a flat rib portion that compresses against said o-ring tab to insure a water tight seal between said flat rib portion and said o-ring tab;

said flange being configured to apply pressure against the magnetic speaker which presses against said o-ring for ensuring a water tight seal;

a utensil shaped tip that is interchangeably securable to said upper body of said handle;

a sound chamber formed on said lower body, said sound chamber forming an inner cavity and including a plurality of wire slots;

a waterproof, magnetic speaker sized and configured for storage in the inner cavity of said sound chamber;

said plurality of wire slots formed on said sound chamber being sized and configured to permit passage of water therethrough;

a printed circuit board located in the inner cavity of said handle, said printed circuit board including a plurality of switches in connection with a sound chip that includes a plurality of digital sound files, each of said plurality of switches being linked to a corresponding one of said plurality of digital sound files, and wherein said printed circuit board is in electrical connection with said magnetic speaker; and a plurality of buttons mounted within said handle, each of said plurality of buttons being depressible against a corresponding one of said plurality of switches on said printed circuit board for causing the corresponding one of the plurality of digital sound files to play through said magnetic speaker.

2. The waterproof, sound emitting feeding utensil as recited in claim 1 wherein said utensil shaped tip is in a spoon shaped configuration.

3. The waterproof, sound emitting feeding utensil as recited in claim 1 wherein said utensil shaped tip is in a fork shaped configuration.

4. The waterproof, sound emitting feeding utensil as recited in claim 1 wherein said utensil shaped tip is in a knife shaped configuration.

5. The waterproof, sound emitting feeding utensil as recited in claim 1 wherein a bulbous member is included at a distal end of said handle for enhancing the sound emitted by said magnetic speaker.

* * * * *